US012274374B2

(12) United States Patent
Sauer et al.

(10) Patent No.: US 12,274,374 B2
(45) Date of Patent: Apr. 15, 2025

(54) BABY CARRIER

(71) Applicant: CHARLIE PRODUCTION GMBH, Hofheim (DE)

(72) Inventors: Anna Sauer, Hofheim (DE); Robert Brodhage, Hofheim (DE)

(73) Assignee: CHARLIE PRODUCTION GMBH, Hofheim (DE)

( * ) Notice: Subject to any disclaimer, the term of this patent is extended or adjusted under 35 U.S.C. 154(b) by 0 days.

(21) Appl. No.: 18/805,672

(22) Filed: Aug. 15, 2024

(65) Prior Publication Data

US 2025/0057330 A1 Feb. 20, 2025

(30) Foreign Application Priority Data

Aug. 16, 2023 (AT) ..... A 50654/2023

(51) Int. Cl.
*A47D 13/02* (2006.01)

(52) U.S. Cl.
CPC ..... *A47D 13/02* (2013.01)

(58) Field of Classification Search
CPC ..... A47D 13/02; A47D 13/025
USPC ..... 224/159, 160, 901.4
See application file for complete search history.

(56) References Cited

U.S. PATENT DOCUMENTS 10,271,663 B2 * 4/2019 Salazar ..... A47D 13/025
11,382,438 B2 * 7/2022 Chuah ..... A47D 13/025
11,589,684 B2 * 2/2023 Chuah ..... A47D 13/025
11,647,847 B2 * 5/2023 Fan ..... A47D 13/02 224/159
11,684,175 B2 * 6/2023 Telford ..... A47D 13/025 224/160
11,786,055 B2 * 10/2023 Telford ..... A47D 13/025 224/159
12,059,080 B2 * 8/2024 Fan ..... A47D 13/02
(Continued)

FOREIGN PATENT DOCUMENTS

AT 11620 U2 2/2011
CN 210138005 U 3/2020
(Continued)

OTHER PUBLICATIONS

Decision to Grant dated Jun. 12, 2024 corresponding to Austrian Patent Application No. A 50654/2023, with English translation thereof.
(Continued)

*Primary Examiner* — Justin M Larson
(74) *Attorney, Agent, or Firm* — SQUIRE PATTON BOGGS (US) LLP

(57) ABSTRACT

A wraparound carrier device for babies or toddlers includes a carrier part. An inner side of the carrier part can be brought into contact with a back or stomach of a baby or toddler being carried. A waist belt is attached to at least a central region of a lower edge of the carrier part, and is guided with an inner side in a waist or hip region of a carrying person around their stomach and back. Two shoulder straps are provided, one end of each of which is attached to the carrier part at an upper edge thereof. An anchor point of a second end of each shoulder strap is attachable to the waist belt or
(Continued)

to a side edge of the carrier part The position of the anchor point on the waist belt or the side edge of the carrier part is adjustable.

10 Claims, 13 Drawing Sheets

(56) References Cited

U.S. PATENT DOCUMENTS

| | | | | |
|---|---|---|---|---|
| 12,089,753 | B2 * | 9/2024 | Telford | A47D 13/025 |
| 2011/0101051 | A1 * | 5/2011 | Parness | A47D 13/025 224/160 |
| 2014/0263491 | A1 | 9/2014 | Telford et al. | |
| 2014/0319189 | A1 * | 10/2014 | Hoppener-Visser | A47D 13/025 224/160 |
| 2019/0075937 | A1 * | 3/2019 | Salazar | A47D 13/025 |
| 2019/0350379 | A1 | 11/2019 | Antunovic | |
| 2022/0202202 | A1 | 6/2022 | Fan | |
| 2023/0135559 | A1 * | 5/2023 | Visser | A47D 13/029 224/159 |
| 2023/0190008 | A1 * | 6/2023 | Zimniewicz | A47D 13/025 224/160 |

FOREIGN PATENT DOCUMENTS

| | | | |
|---|---|---|---|
| CN | 214760240 | U | 11/2021 |
| CN | 114587111 | A | 6/2022 |
| DE | 20 2022 107 069 | U1 | 3/2023 |
| EP | 3 552 523 | A1 | 10/2019 |

OTHER PUBLICATIONS

Official Letter and Search Report dated Mar. 20, 2024 corresponding to Austrian Patent Application No. A 50654/2023, with English translation thereof.

German Office Action dated Aug. 9, 2024 corresponding to German Patent Application No. 10 2023 121 872.7.

Search Report dated Dec. 6, 2024, corresponding to European Patent Application No. 24 19 4488.

* cited by examiner

BABY CARRIER

CROSS REFERENCE TO RELATED APPLICATION

This application claims the benefit of Austrian Patent Application No. A50654/2023, filed Aug. 16, 2023. The entire content of the above-referenced application is hereby incorporated by reference.

BACKGROUND

Field

The invention relates to wraparound carrier device for babies or toddlers according to claim 1.

Description of the Related Art

Such wraparound carrier devices are already known from the prior art. These wraparound carrier variants known from the prior art are characterized above all by the fact that there are often a large number of adjustment options in order to adapt the wraparound carrier device well to the baby or toddler (hereinafter simply referred to as child) to be carried. However, these wraparound carrier devices lack the possibility to adjust the wraparound carrier device to the body of the person wearing it with sufficient precision, as only a few fixed adjustment options are provided. This often leads to pain and possibly even orthopedic problems when worn for a long time. People with special physical requirements in particular are often prevented from using such a wraparound carrier device due to the lack of adjustment options.

The document EP 3 552 523 A1 discloses a wraparound carrier device for babies or toddlers. Said wraparound carrier device has a back textile in which the child is placed before the wraparound carrier device is put on. On a lower edge of the back textile, a waist belt is provided which is to be guided in a waist or hip region of the carrying person around their stomach and back. Shoulder straps are attached to an upper edge of the back textile. To increase the comfort of a person using the carrier, cushions can be placed in a pocket provided in the shoulder straps.

SUMMARY

It is the object of the present invention to provide an improved wraparound carrier device which is suitable for a wide range of sizes, weights and body shapes of a carrying person and also for carrying persons with special physical requirements.

The object of the invention is achieved by a wraparound carrier device according to claim 1. Advantageous embodiments are the subject matter of the dependent claims.

A wraparound carrier device for babies or toddlers (in the following description simply referred to as child or children) according to the invention is provided with a carrier part (wraparound carrier part) having an inner side and an outer side. The inner side can be brought into contact with the back or stomach of a baby or toddler being carried. A waist belt is attached to the carrier part at least at a central region of an edge of the carrier part defined as a lower edge, and is provided to be guided with an inner side in a waist or hip region of a carrying person around their stomach and back. Two shoulder straps (shoulder belts) are each attached with one end to the carrier part at an edge of the carrier part defined as the upper edge. An anchor point of a second end of each shoulder strap is designed to be attachable to the waist belt or to an edge of the carrier part defined as a side edge on the carrier part. The position of the anchor point on the waist belt or the side edge of the carrier part is infinitely adjustable or changeable.

Since the shoulder straps can be attached to the waist belt or to the side edge of the carrier part, and their exact anchor point position is infinitely adjustable, the wraparound carrier device according to the invention offers a variety of adjustment options that significantly improve the comfort and ergonomics of the carrying person. This makes it possible to infinitely adjust the shoulder straps, particularly with regard to their guide angle. This prevents the shoulder straps from cutting into the neck of the carrying person. Another ergonomic improvement is the option of changing the anchor points from the waist belt to the side edge of the carrier part or vice versa.

Preferably, the anchor point can be designed in the form of a flat hook-and-loop fastener patch, which is equipped with a hook-and-loop fastener portion of hooks or loops on at least one side.

A hook-and-loop fastener patch according to the invention is a piece of flat fabric of any shape which is equipped with a hook-and-loop fastener portion on at least one side. The hook-and-loop fastener portion consists either of hooks or of loops. In particular, it is advantageous that one side of the hook-and-loop fastener patch is equipped with hooks and the other side is equipped with loops.

The waist belt can be provided with a flap, which is foldable towards the inner side of the waist belt, on an edge directed away from the lower edge of the carrier part. The flap can be equipped with a hook-and-loop fastener portion of hooks or loops on a side that can be brought into contact with the inner side of the waist belt. Alternatively or additionally, the waist belt can be equipped with a hook-and-loop fastener portion of hooks or loops in a region that can be covered by the folded flap.

Advantageously, it is possible here to attach the hook-and-loop fastener patch anywhere on the waist belt between the inner side of the waist belt and the side of the flap directed towards the inner side of the waist belt. The hook-and-loop fastener patch can also be twisted, i.e. the angle at which the shoulder strap is guided to the waist belt can be adjusted.

A plurality of flaps extending over the entire length of the waist belt can be provided.

According to this embodiment, the flaps can be folded over to the waist belt without the risk of wrinkling, and it is also not necessary to remove a single large flap over the entire length of the waist belt therefrom in order to slightly change the position or orientation of the anchor point (hook-and-loop fastener patch).

A side edge flap, which is foldable towards the inner side of the carrier part, can be provided on each side edge of the carrier part. The side edge flap is equipped with a hook-and-loop fastener portion of hooks or loops on a side that can be brought into contact with the inner side of the carrier part. Alternatively or additionally, the carrier part is equipped with a hook-and-loop fastener portion of hooks or loops along the side edge in a region that can be covered by the folded side edge flap.

In a similar manner as described above with reference to the waist belt, the anchor points can also be infinitely adjustable on the side edge instead of on the waist belt and can be arranged in any orientation regarding an angle.

Side regions can be provided on the lower edge of the carrier part, which can be displaced towards the center of the carrier part independently of the waist belt. A tail extending the side edge is provided on the side regions, which is equipped with a hook-and-loop fastener portion of hooks or loops on at least one side in a region overlapping the waist belt.

According to this embodiment, it is possible to adjust the lower portion of the carrier part to the hips of the child. As a result, the legs of the child hanging out to the sides are not spread excessively, but are held in an age-appropriate manner. Unwanted drooping of the legs is avoided, as the width of the carrier part in the hip region can be adjusted precisely to the distance from the back of the knee to the back of the knee of the child. This ensures an ideal spread-squat position. Although two creases are created by the displacing, this does not affect the child being carried.

The shoulder straps can be designed to be connected to the hook-and-loop fastener patch at their second ends via click fasteners.

A click fastener is a fastener consisting of a male part and a female part. The male part has two compressible tongues that are pressed together when inserted into an opening in the female part and, after overcoming a protrusion in the female part, are spread apart and held by the protrusion. By pressing on the tongues through an opening in the female part, they can be pressed together and the male part can be removed from the female part to open the click fastener without damage. Other names for a click fastener are quick release buckle, snap buckle or push-in buckle.

The option of detaching the hook-and-loop fastener patch from the shoulder straps and attaching it again allows to easily put on the wraparound carrier device after adjustment by positioning the hook-and-loop fastener patch at the intended place on the waist belt or the side edge of the carrier part, and then to fix it by closing the click fasteners. In addition, the anchor points of the shoulder straps can be easily changed by repositioning between the waist belt and the side edge of the carrier part when using several hook-and-loop fastener patches. This eliminates the need to remove the wraparound carrier device, as the hook-and-loop fastener patches are already correctly adjusted and in place.

Markings can be provided on the waist belt and/or the side edges.

Such markings can be used to memorize preferred adjustment positions of the anchor points of different people using the wraparound carrier device.

The wraparound carrier device according to the invention can be used in a comfortable manner and without restriction by any person, even those with special physical requirements, by means of almost unlimited adjustment options. This is mainly achieved by the fact that the possibility of adjusting different guide angles for the shoulder straps can cause a change or adjustment of the pulling forces acting thereon. The wraparound carrier device according to the invention can be worn in many different ways. These are, for example: The child is positioned on the stomach of the carrying person with the shoulder straps crossed over the back of the carrying person and guided to the waist belt; the child is positioned on the stomach of the carrying person with the shoulder straps crossed over the back of the carrying person and guided to the side edges of the carrier part; the child is positioned on the back of the carrying person with the shoulder straps crossed over the chest of the carrying person and guided to the waist belt; or the child is positioned on the back of the carrying person with the shoulder straps guided straight along the flank of the carrying person to the waist belt or under the armpits of the carrying person to the side edges of the carrier part.

BRIEF DESCRIPTION OF THE DRAWINGS

Further advantages of the invention will become apparent from the following description with reference to the Figures, which show a currently preferred embodiment of the invention.

The Figures show the following.

The Figures show a currently preferred embodiment of the invention. It should be noted here that, for reasons of clarity, not all reference signs are always provided in each Figure, but particularly the reference signs of the components relevant based on the Figure described.

DETAILED DESCRIPTION

Figure 1:
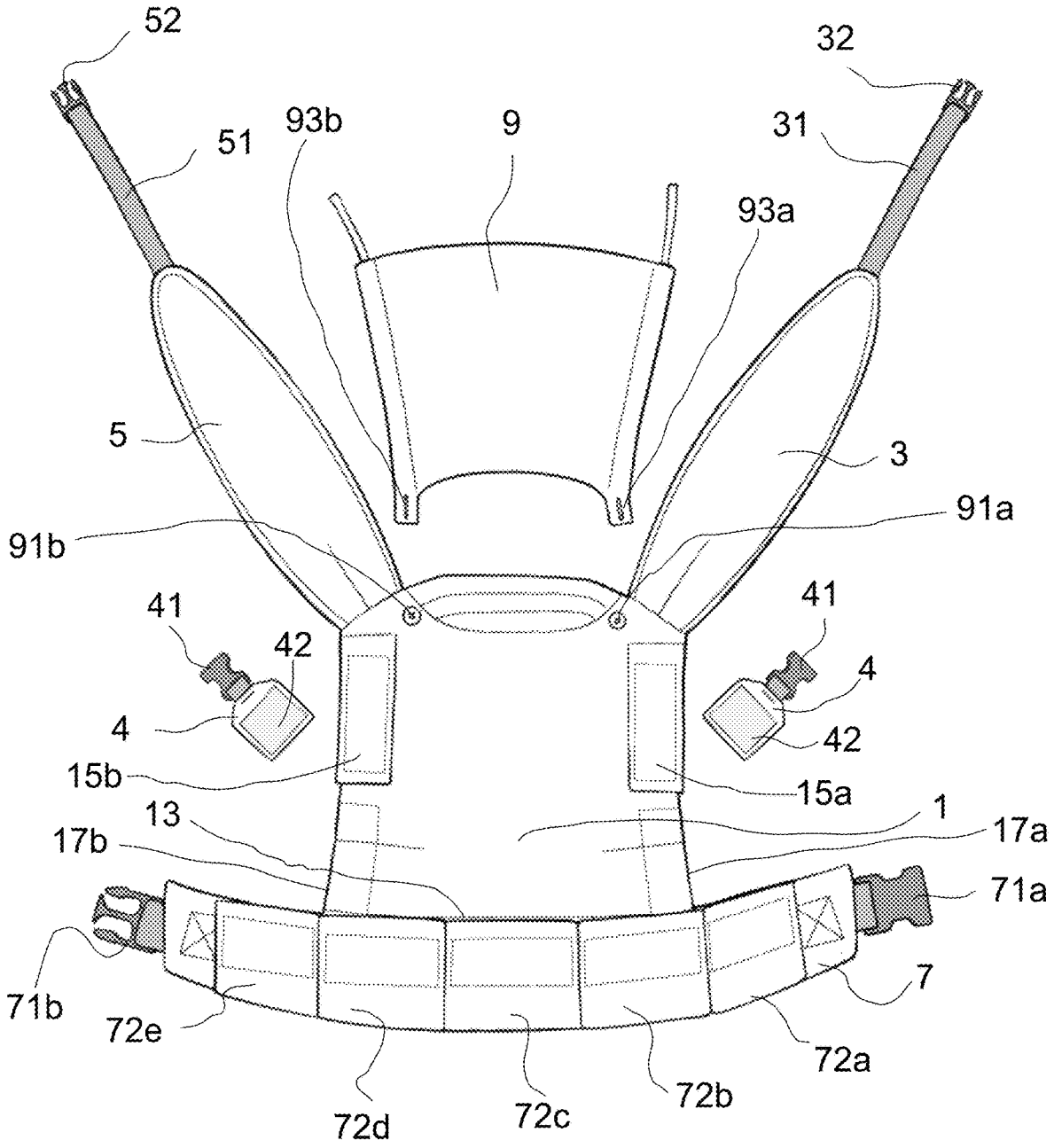
FIG. 1 shows a view of a wraparound carrier device with a view of the inner side thereof, including hook-and-loop fastener patches and headrest/hood.

FIG. 1 shows a wraparound carrier device according to the embodiment in a laid-out state with a view of an inner side. When worn, the inner side is directed to the baby or toddler (hereinafter also referred to as child) and to the person using the carrier device.

The wraparound carrier device has a carrier part 1 to which other elements are attached. In particular, these elements are shoulder straps 3 and 5, which are attached to an upper edge of the carrier part 1. A waist belt 7 is located on a lower edge 13 of the wraparound carrier device. The waist belt is only attached to the carrier part 1 at a central region of the lower edge 13, while lateral regions of the carrier part 1 are not connected to the waist belt 7, but are merely in contact therewith.

The shoulder straps have webbing straps 31 and 51 with second ends, which are equipped with male elements 32 and 52 of a click fastener. These male elements 32 and 52 are each provided to snap in female elements 41, 41 of the click fastener in the known manner. The female elements 41, 41 are each attached to a hook-and-loop fastener patch 4. This creates a detachable connection between the shoulder straps 3 and 5 having the webbing straps 31 and 51 and the hook-and-loop fastener patches 4, 4.

The hook-and-loop fastener patch 4 is a plane piece of fabric made of any material, which is equipped on one side with a hook-and-loop fastener material of loops and on the other side with a hook-and-loop fastener material of hooks (hereinafter also referred to as loops or hooks) as a hook-and-loop fastener portion 42.

With regard to the hook-and-loop fastener material, it is defined for the further description that each pairing of hook-and-loop fastener material has a part with loops and a part with hooks. Therefore, the following description does not clearly define whether an individual part is provided with loops or hooks, as a skilled person will assume that the described pairings comprise both types of hook-and-loop fastener material.

A headrest 9 has two buttonholes 93*a*, 93*b* on one edge by which it can be connected to the carrier part 1 via buttons provided on the upper edge of the carrier part 1. The headrest 9 is removable as it is no longer needed for larger children. The headrest 9 can also be used as a hood to protect the child in bad weather or also strong sunshine.

The lower edge of the waist belt 7, i.e. the edge pointing away from the lower edge of the carrier part 13, has a plurality of flaps 72*a* to 72*e* that can be folded towards the inner side of the waist belt 7.

Figure 2A:
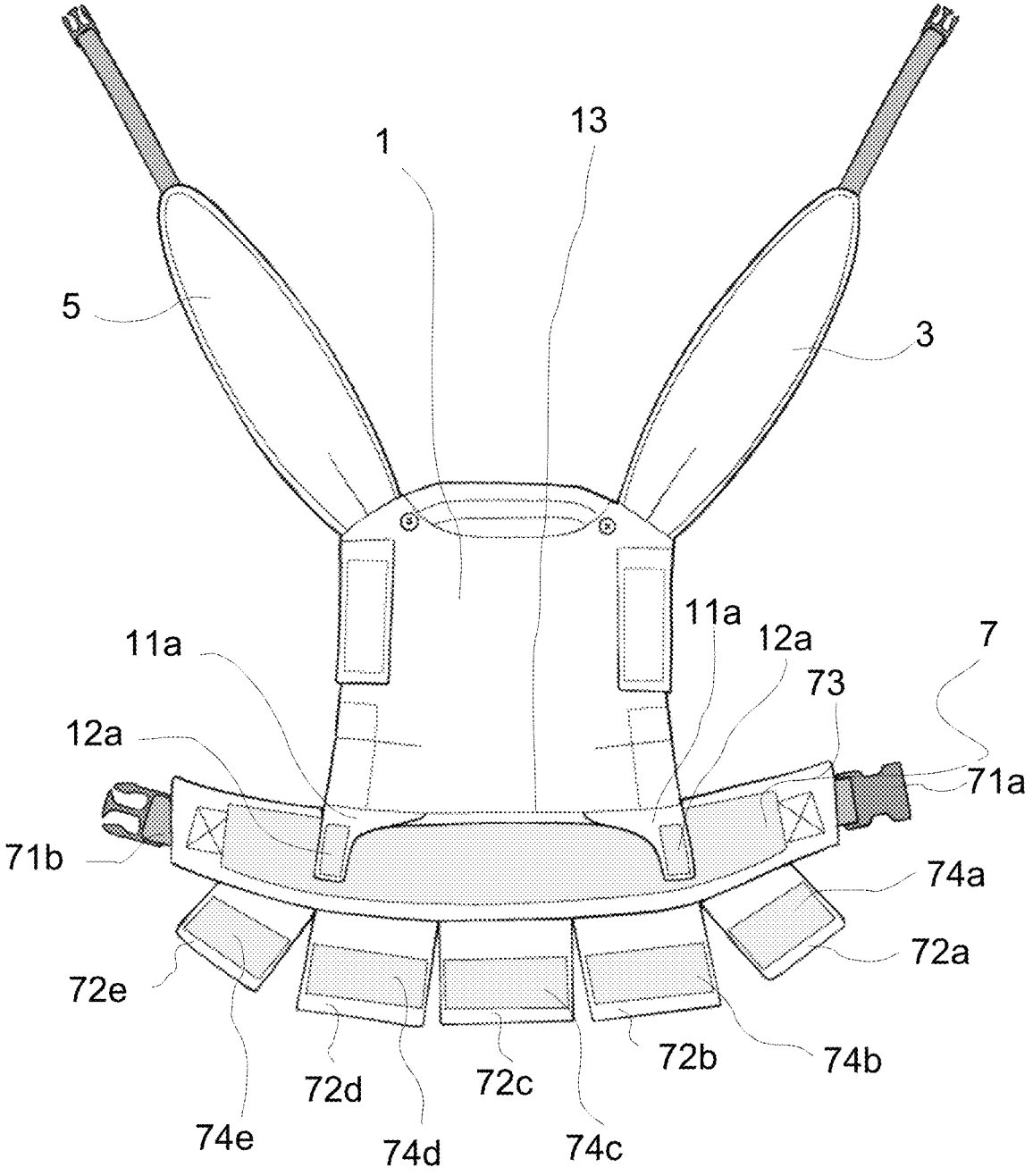
FIGS. 2*a* to 2*c* show views illustrating an adjustment to the hip of a baby or toddler being carried.

As can be seen in FIG. 2*a*, for example, the flaps 72*a* to 72*e* have hook-and-loop fastener portions 74*a* to 74*e* on the side that is to be brought into contact with the inner side of the waist belt 7, said portions coming into contact with a hook-and-loop fastener portion 73 on the waist belt 7 by folding the flaps and connecting the flaps 72*a* to 72*e* to the waist belt. The flaps 72*a* to 72*e* are provided in particular to receive therebetween the two hook-and-loop fastener patches 4, 4 to be connected to the shoulder straps 3 and 5 via the click fasteners described above.

The hook-and-loop fastener portions 42, 42 of the hook-and-loop fastener patches 4, 4 engage on one side with the respective hook-and-loop fastener portions 74*a* to 74*e* of the flaps 72*a* to 72*e*. On the other side, the hook-and-loop fastener portions 42, 42 of the hook-and-loop fastener patches engage with the hook-and-loop fastener portion 73 of the waist belt. This ensures a reliable connection of the shoulder straps 3, 5 and the waist belt 7 after closing the click fastener 32, 41 and 52, 41. The waist belt 7 itself also has a click fastener 71*a*, 71*b* for closing the waist belt 7 by guiding the waist belt 7 around the body of the carrying person in the waist or hip region after the wraparound carrier device has been put on.

At an upper region, parallel to the side edges 17*a*, 17*b* of the carrier part 1, there are also side edge flaps 14*a*, 14*b* equipped with hook-and-loop fastener portions 15*a*, 15*b* which, by folding them over, come into engagement with hook-and-loop fastener portions 16*a*, 16*b* on an upper lateral region of the carrier part 1. On these side flaps 14*a*, 14*b*, there is also the possibility to reliably fix the hook-and-loop fastener patch 4 between the side flaps and the carrier part 1.

Figure 2B:
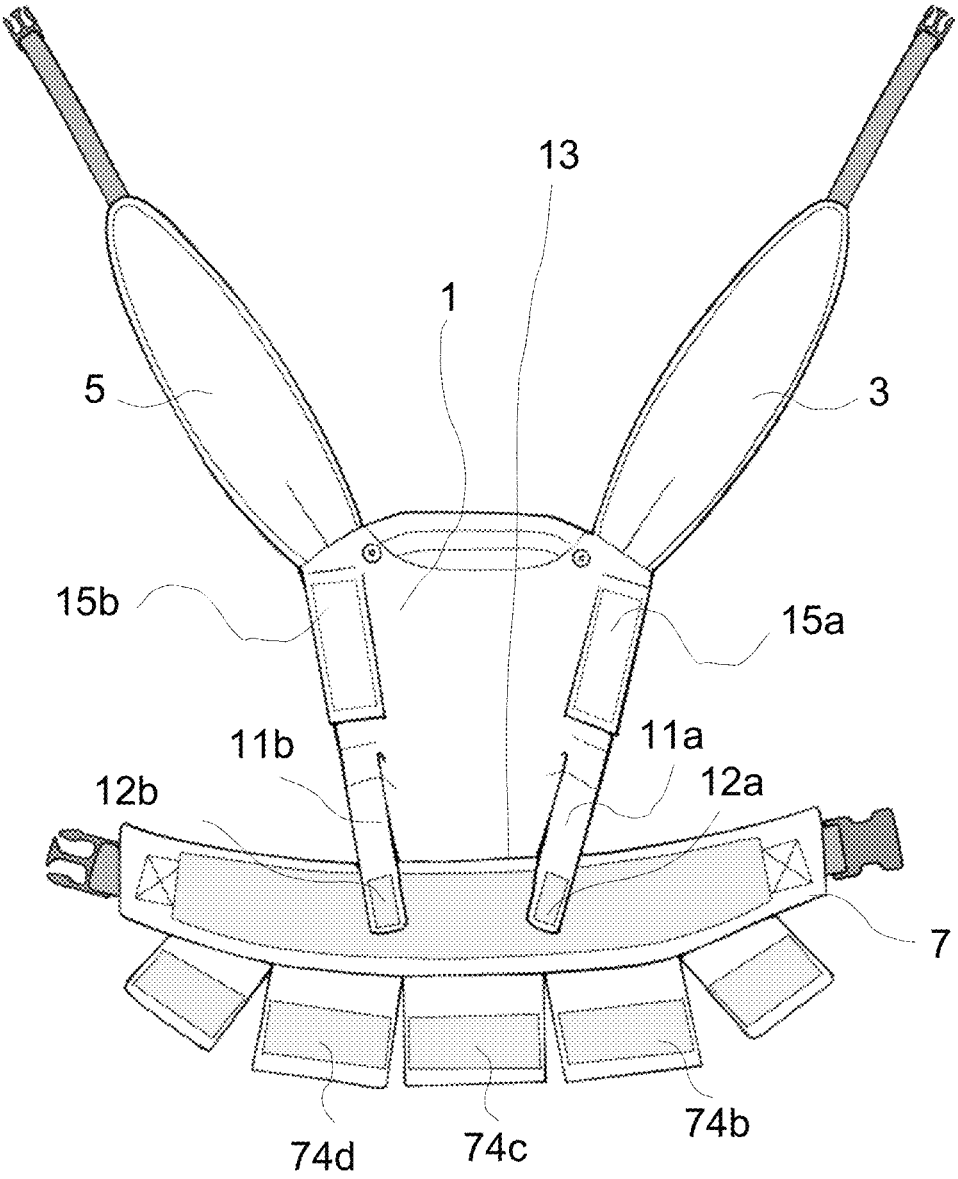
Figure 2C:
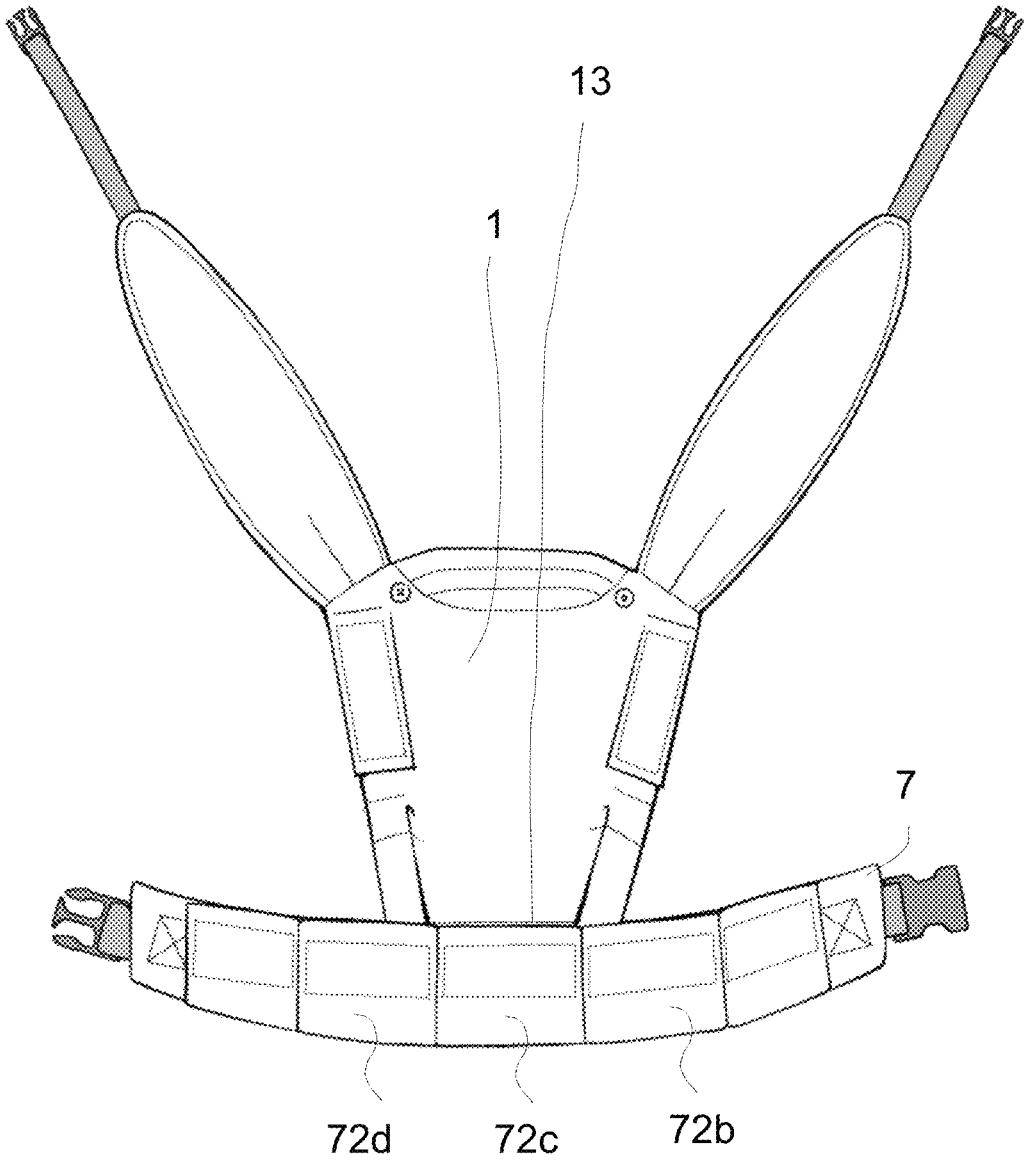

FIGS. 2*a* to 2*c* now describe one way of adjusting the wraparound carrier device to a hip of a child being carried.

As described above, the waist belt 7 is only attached to the carrier part 1 in a central region of the lower edge 13, e.g. sewn thereto, while the lateral regions are loose. In these lateral regions, the carrier part 1 is extended along its side edges 17*a*, 17*b* in the form of tail portions 11*a* and 11*b*, which are equipped with hook-and-loop fastener portions 12*a*, 12*b* on both sides. By displacing the tail portions 11*a*, 11*b* of the carrier part, which are not attached to the waist belt 7, and by fixing the hook-and-loop fastener portions 12*a*, 12*b* at a suitable position on the hook-and-loop fastener portion 73 of the waist belt 7, the width of the carrier part 1 in the hip region of the child being carried can be adjusted to the hips of the child, as shown in FIG. 2*b*. This prevents excessive or too little spread of the legs of the child. An ideal spread-squat position can be achieved.

After positioning the tail portions 11*a*, 11*b*, the corresponding ones of the flaps 72*a* to 72*e* are closed for reliable fixation, as shown in FIG. 2*c*.

Figure 3:
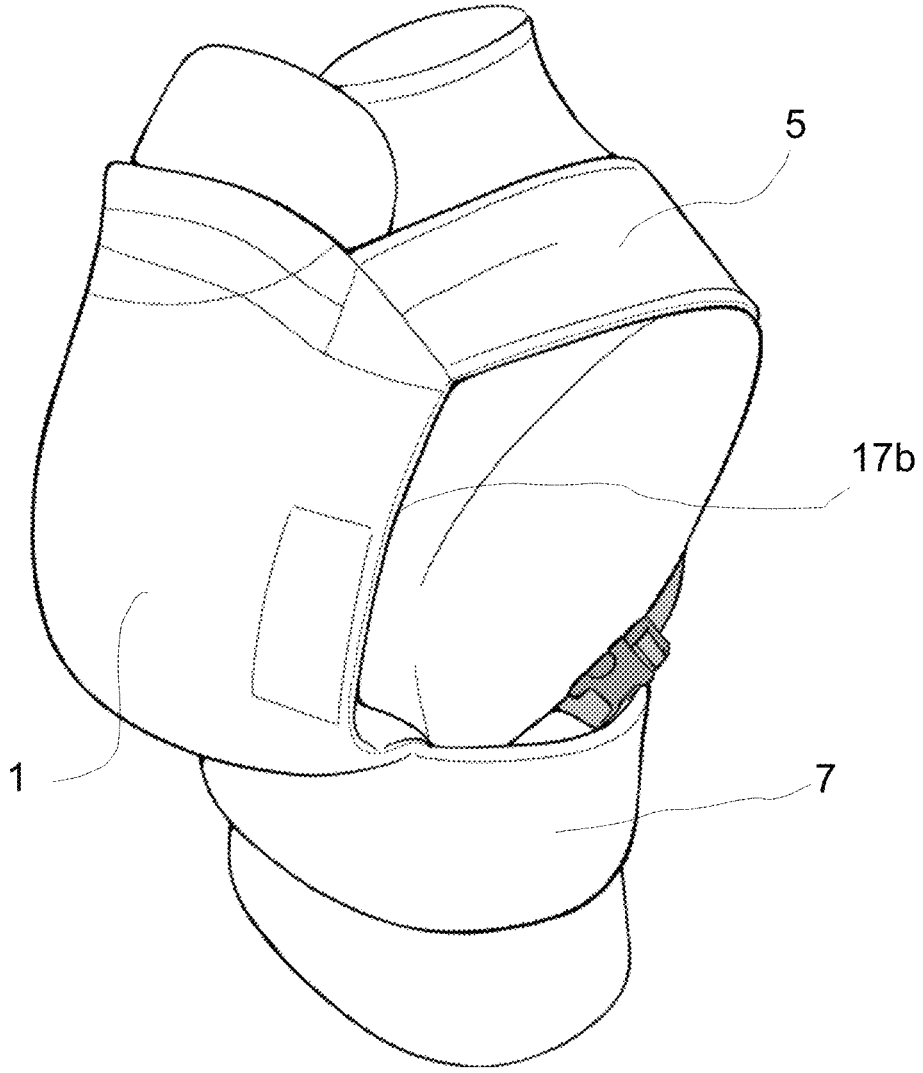
FIG. 3 shows a view illustrating a first way of carrying the wraparound carrier device.
Figure 4A:
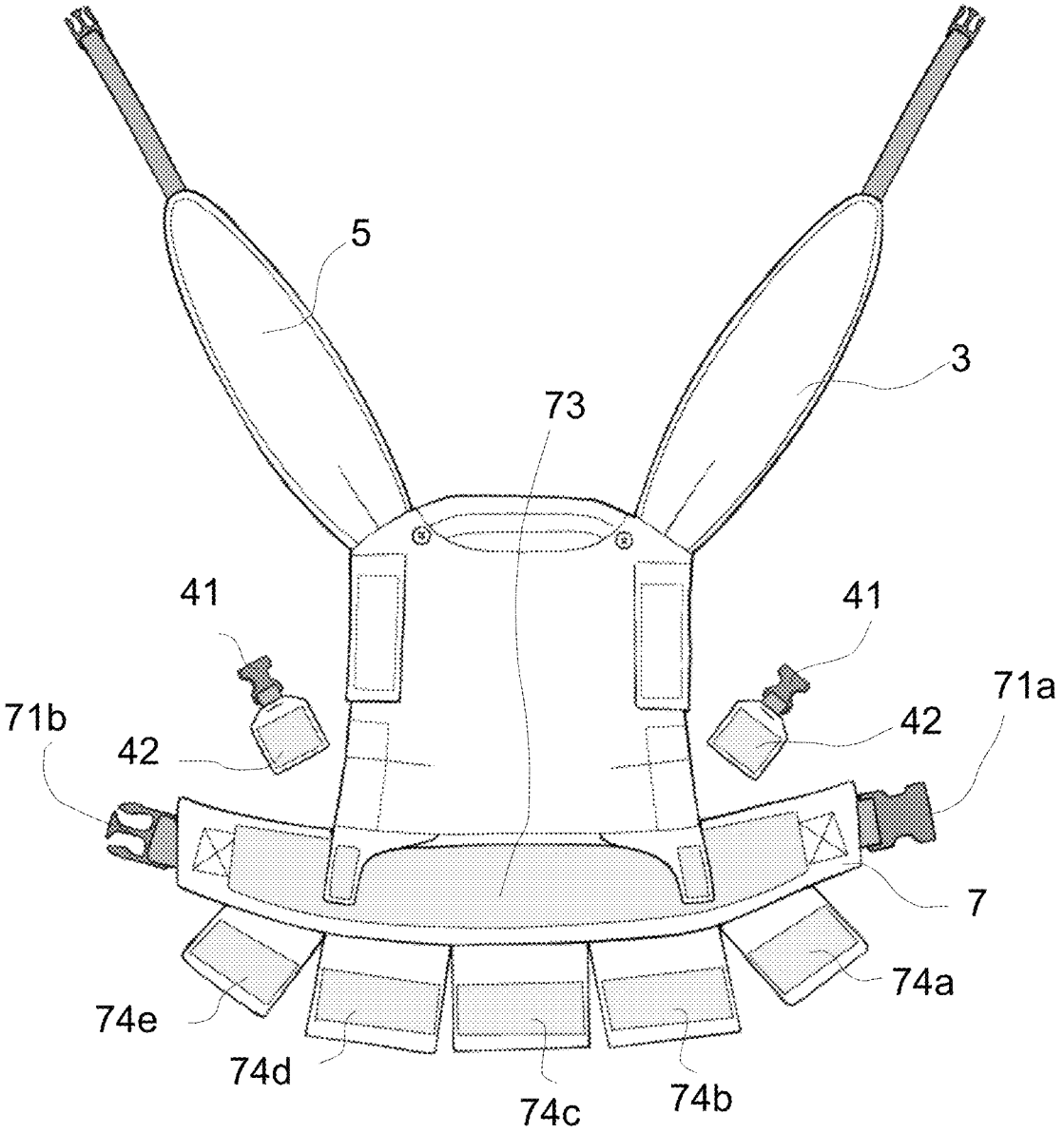
FIGS. 4*a* to 4*c* show views illustrating adjustment options when applying the first way of carrying.
Figure 4B:
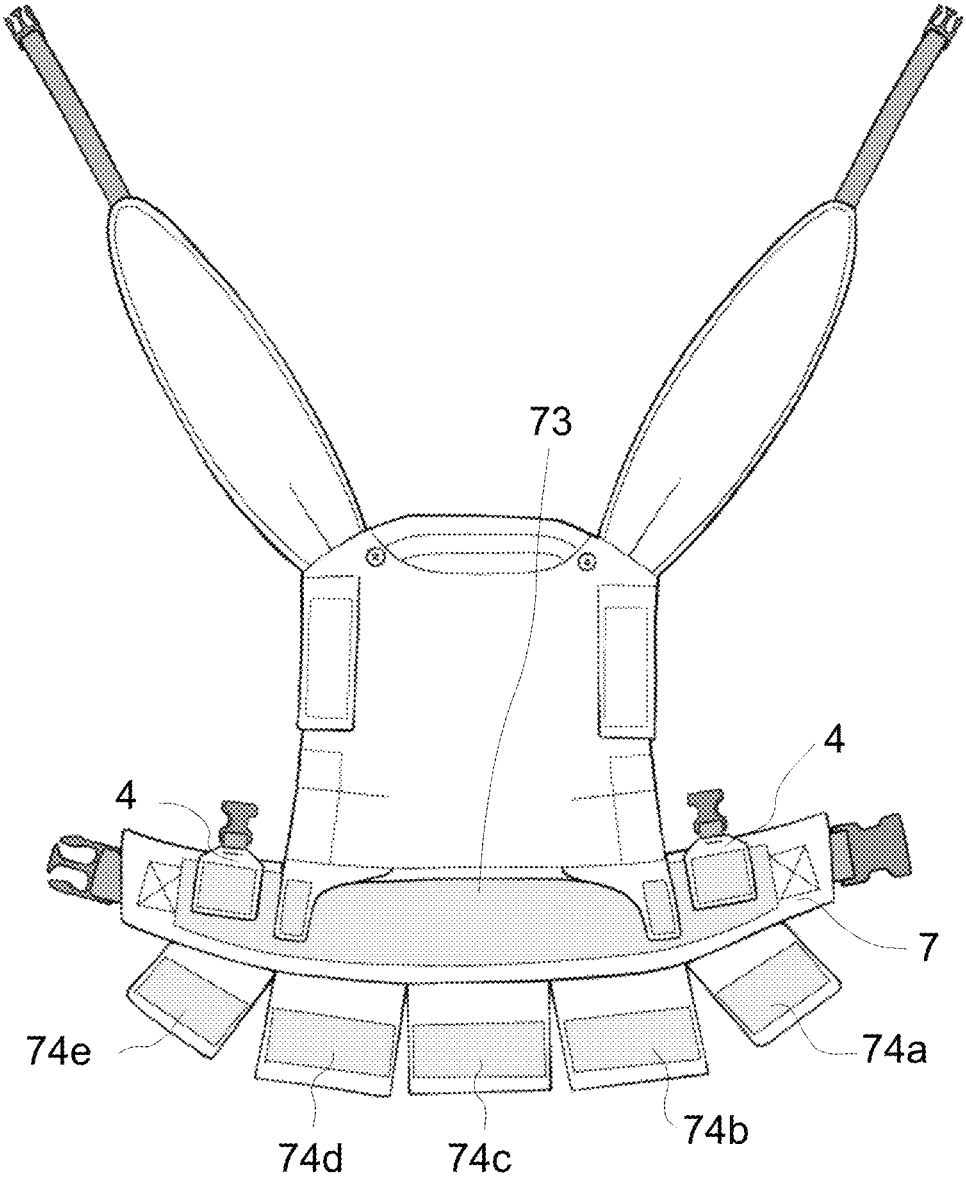
Figure 4C:
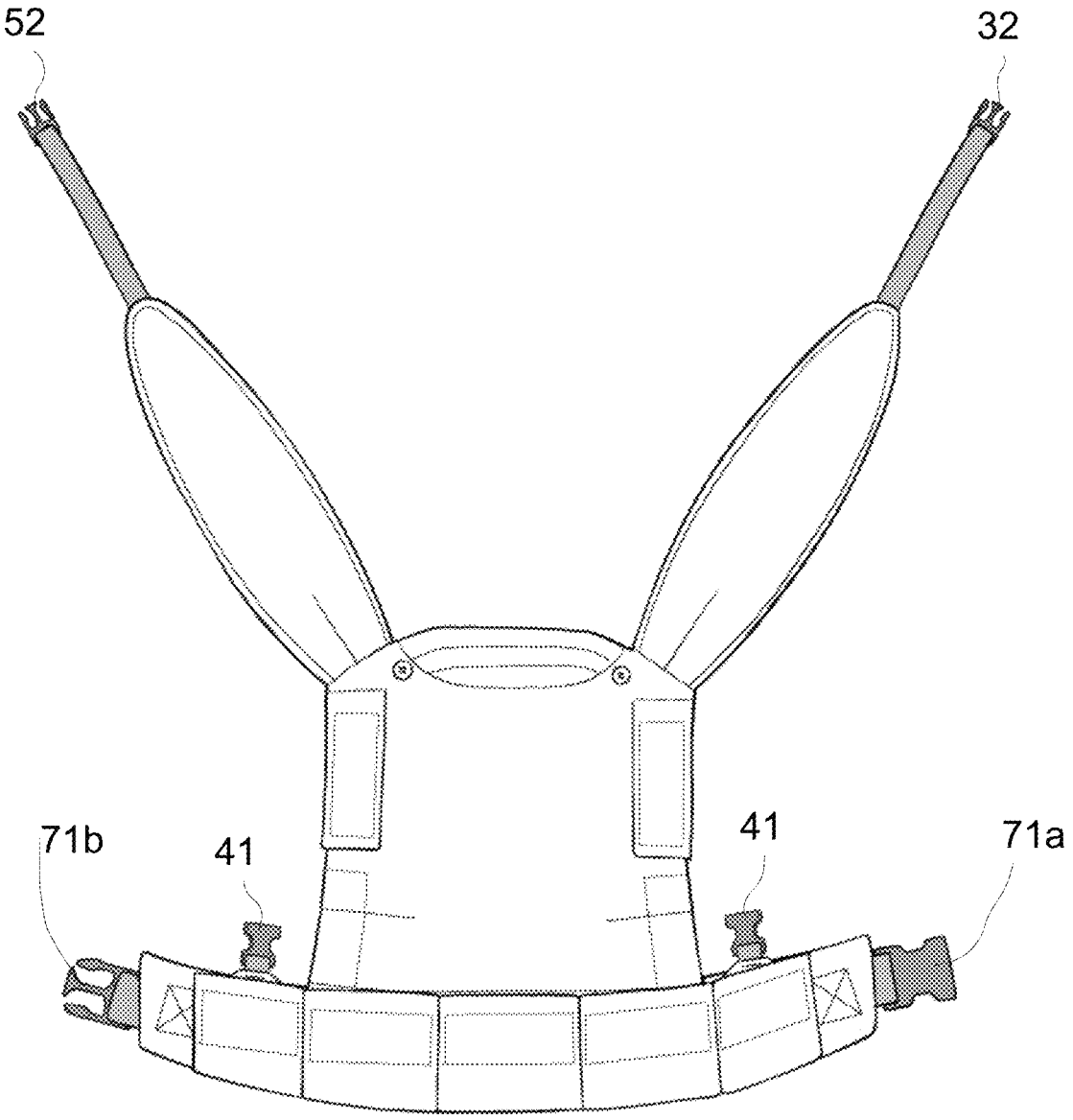

FIG. 3 shows a way of carrying in front of the chest that is more suitable for very small children and FIGS. 4*a* to 4*c* describe adjustment options for this way of carrying.

To be able to carry very small children comfortably, it is ideal if they are positioned higher on the body of the carrying person. For this purpose, after adjusting the width in the hip region of the child as described above, the hook-and-loop fastener patches 4, 4, which serve as anchor points for the shoulder straps 3, 5, are positioned in the preferred position of the waist belt 7 in the manner described above, as shown in FIG. 4*b* as an example. The waist belt 7, which has been adjusted to the ideal length in advance, is then guided around the body of the carrying person and closed with the click fastener 71*a*, 71*b*. Then, the child is lifted up, temporarily supported with the chest area, and then the carrier part 1 is taken to the back of the child.

The shoulder straps 3, 5 are then placed over the shoulders of the carrying person, crossed over at the back, and the male elements 32, 52 of the shoulder straps 3, 5 are inserted into the associated female elements 41, 41 of the hook-and-loop fastener patches 4, 4. This results in the way of carrying shown in FIG. 3.

While carrying the child, it is impossible to accidentally open the hook-and-loop fasteners, as they are secured by the corresponding ones of the folded flaps 72*a* to 72*e*. Furthermore, after folding down, the flaps 72*a* to 72*e* are not accessible from outside but are located on the inner side of the waist belt 7 directed to the carrying person.

FIG. 5 and FIGS. 6*a* to 6*c* show a way of carrying in front of the chest for larger children and adjustment options therefor.

Figure 5:
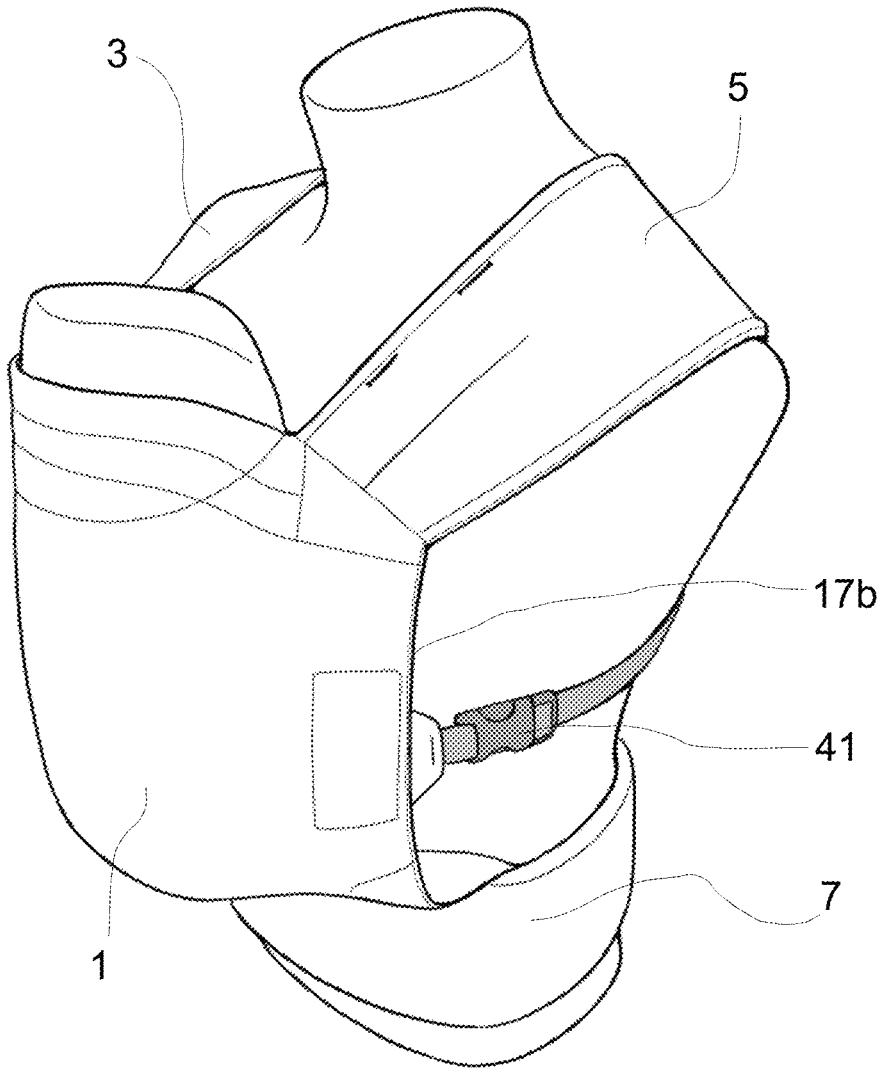
FIG. 5 shows a view illustrating a second way of carrying the wraparound carrier device.
Figure 6A:
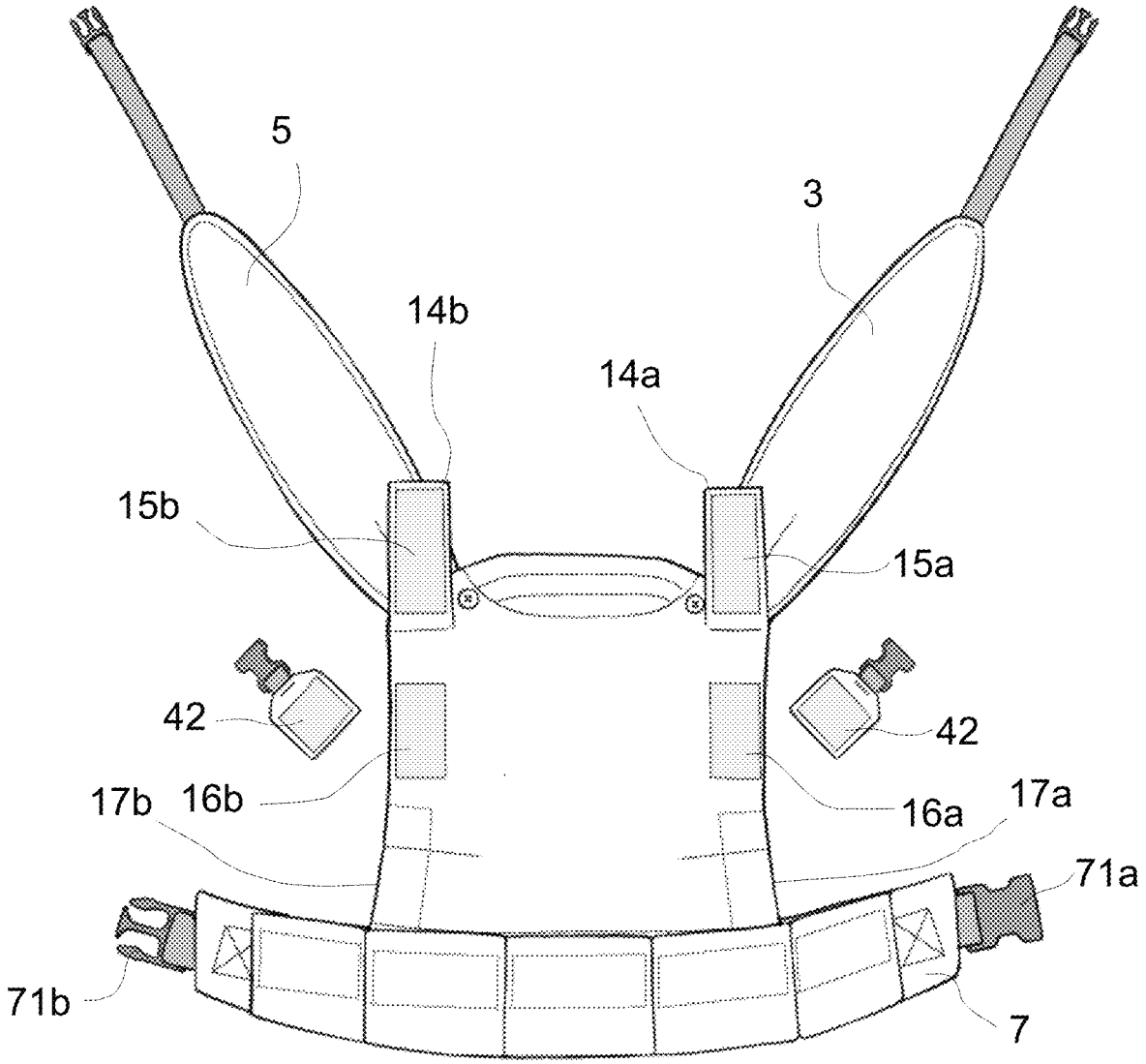
FIGS. 6*a* to 6*c* show views illustrating adjustment options when applying the second way of carrying.
Figure 6B:
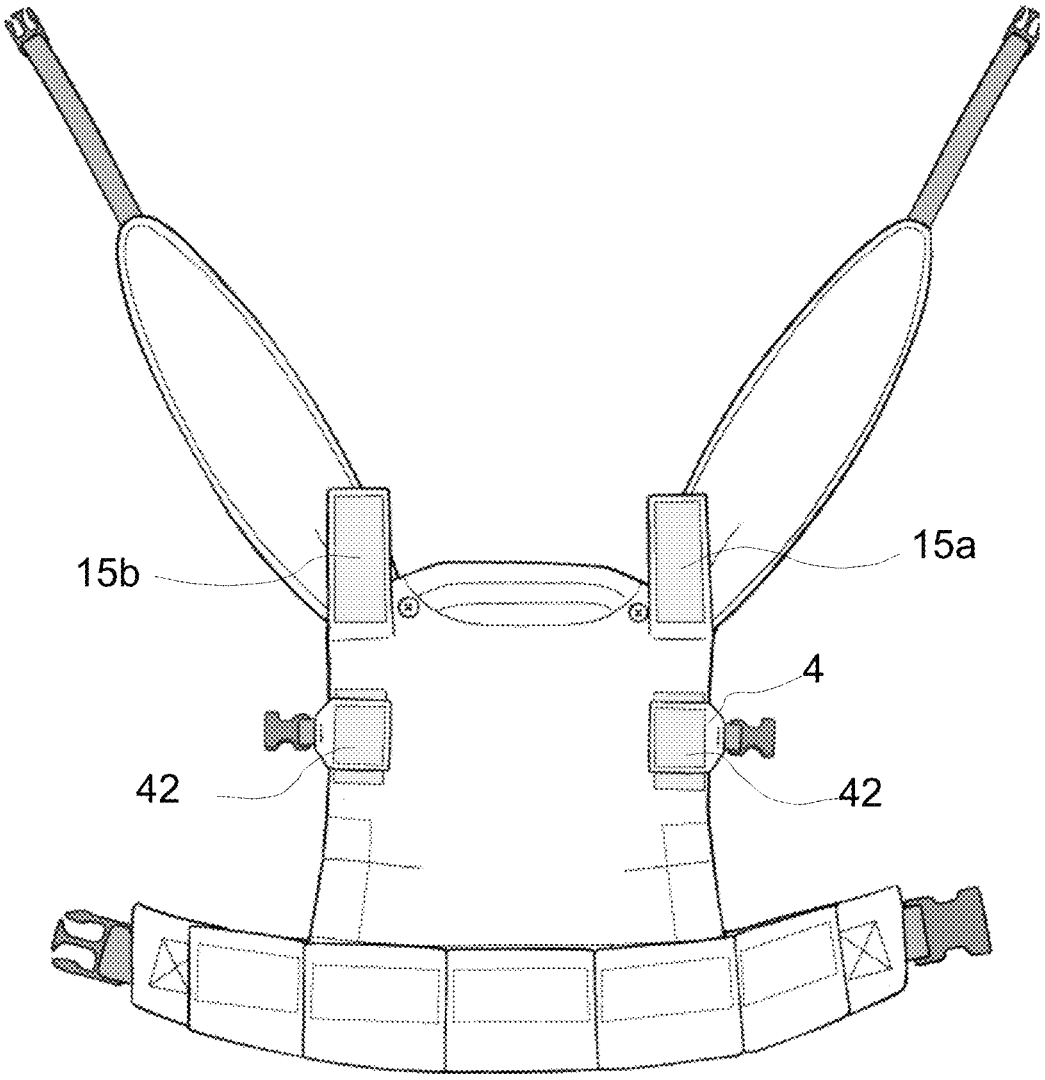
Figure 6C:
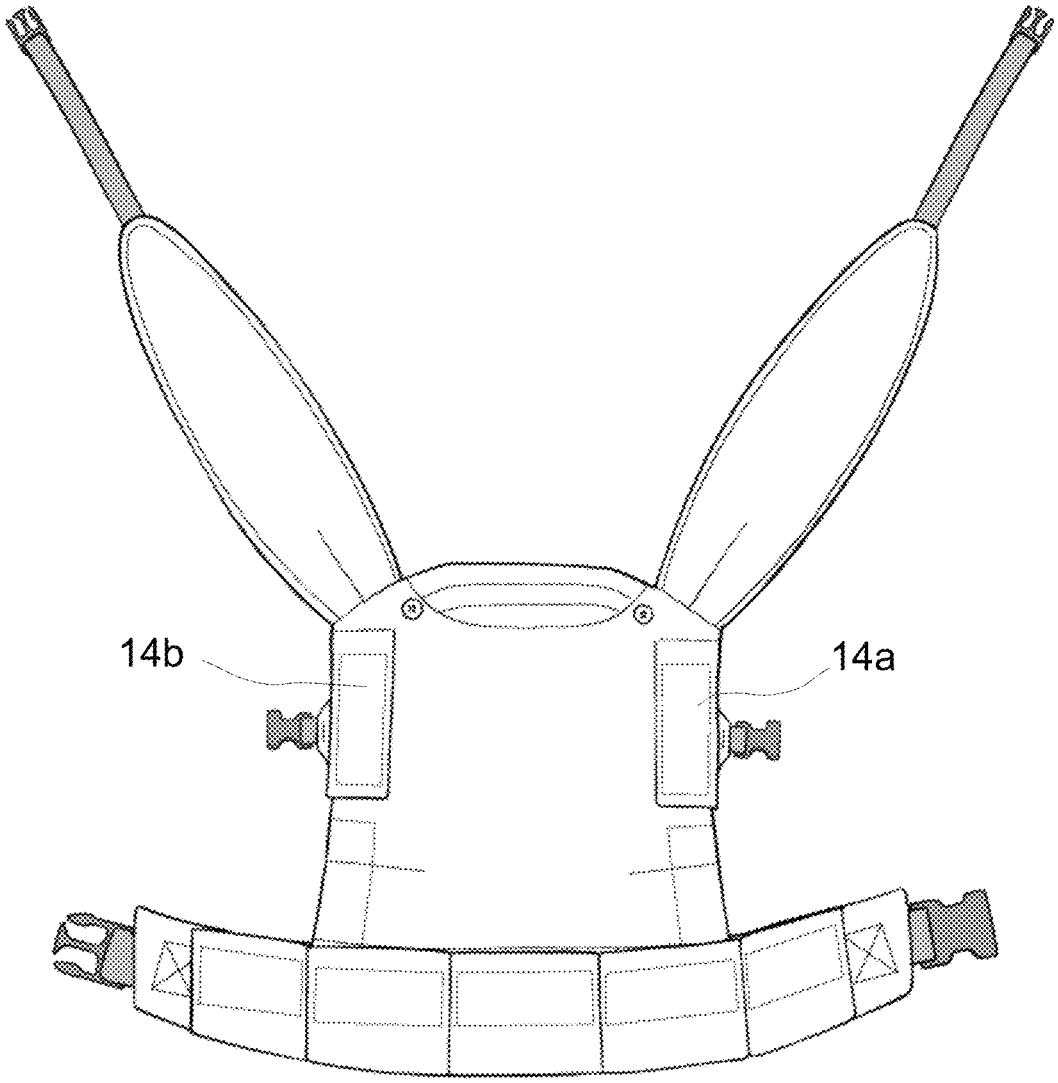

In the way of carrying as shown in FIG. 5, the hook-and-loop fastener patches 4 are attached to the hook-and-loop fastener portions 16*a*, 16*b* in the upper lateral regions of the carrier part, as can be seen in FIG. 6*b*, and are secured by folding over the side edge flaps 14*a*, 14*b*, as can be seen in FIG. 6*c*. This way of carrying makes it possible to guide the shoulder straps 3, 5 to the side edges 17*a*, 17*b* of the carrier part and to infinitely adjust the height of the anchor points. In addition, it is also possible, as in the way of carrying described above, to adjust a guide angle of the shoulder straps 3, 5 by twisting the hook-and-loop fastener patches.

Figure 7:
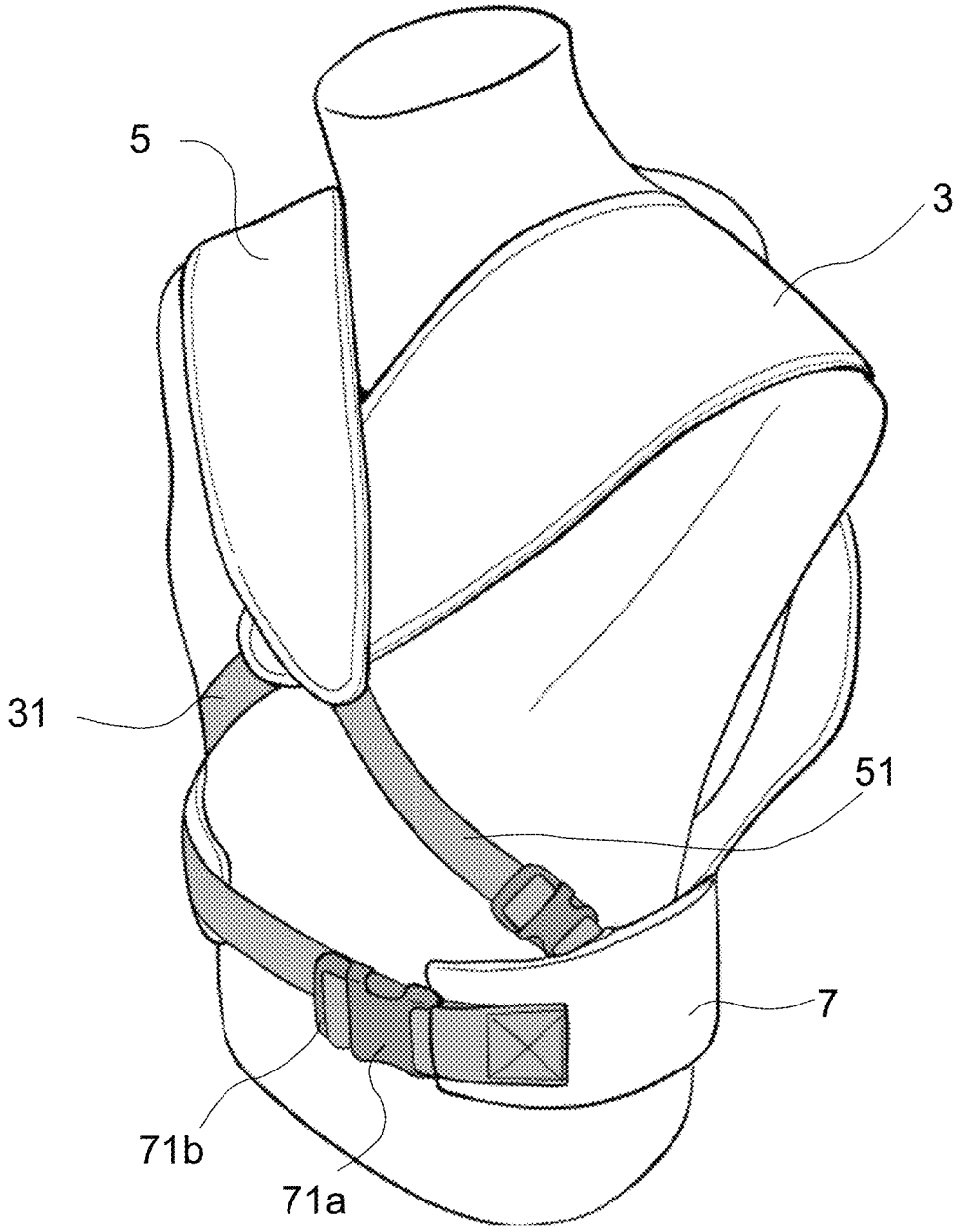
FIG. 7 shows a view illustrating a third way of carrying the wraparound carrier device.

FIG. 7 shows a way of carrying on the back of the carrying person. Since in this case the upper lateral regions of the carrier part are difficult to access for the carrying person by himself/herself, an adjustment of the anchor points on the waist belt is preferred for this way of carrying, as described on the basis of FIGS. 4*a* to 4*c*.

It should also be noted that the description of the embodiment and the illustration in the Figures do not in any way constitute a limitation of the scope of protection. The scope of protection is defined by the appended claims.

Modifications of the embodiment are possible. For example, the hook-and-loop fastener patches 4 are shown in the Figures as being basically rectangular. However, any other shape, such as circles, hearts, stars or animal figures, can be chosen, as long as the load-bearing capacity of the hook-and-loop fastener connection is guaranteed.

If there are several users, differently shaped or colored hook-and-loop fastener patches can also be used in different positions so that it is not necessary to adjust the anchor points before use. Each individual user can then simply connect the shoulder straps to "his/her" hook-and-loop fastener patches. Hook-and-loop fastener patches that are not currently used by the carrying person can be used to temporarily attach other items such as a drinking bottle, cell phone holder, pacifier chain, etc.

Position markings can also be provided in the form of markings that allow a user to quickly find a convenient anchor point position that has already been determined. The markings can be permanently attached to the wraparound carrier device, or they can also be designed as small hook-and-loop fastener patches that can be attached individually.

Instead of click fasteners, other types of fasteners can also be used, such as belt buckles with a pin, magnetic fasteners or form-fit fasteners.

A textile organic material is preferably selected as the material for the wraparound carrier device, but other materials such as fabrics made of synthetic fibers or (plastic) sheets can also be used.

In addition to the way of carrying shown in FIG. 7, the shoulder straps 3, 5 can also be guided straight down to the waist belt without being crossed.

While very small children in particular are carried with the back to the carrier part 1, the wraparound carrier device according to the invention also makes it possible that a child carried in front of the chest can be carried with the stomach facing the carrier part 1, i.e. the child looks in the same direction as the carrying person.

The invention claimed is:

1. A wraparound carrier device for babies or toddlers comprising:

a wraparound carrier part having an inner side and an outer side, wherein the inner side can be brought into contact with a back or stomach of a baby or toddler being carried, a waist belt, which is attached to the wraparound carrier part at least at a central region of an edge of the wraparound carrier part defined as a lower edge, and which is provided to be guided with an inner side in a waist or hip region of a carrying person around their stomach and back, two shoulder straps, one end of each of which is attached to the wraparound carrier part at an edge of the wraparound carrier part defined as the upper edge, wherein an anchor point of a second end of each shoulder strap is designed to be attachable to the waist belt or to an edge of the wraparound carrier part defined as a side edge on the wraparound carrier part, and the position of the anchor point on the waist belt or the side edge of the wraparound carrier part is adjustable such that the anchor point can be disposed at a plurality of selectable angles relative to the waist belt or the side edge of the wraparound carrier part.

2. The wraparound carrier device according to claim 1, wherein the anchor point is in the form of a flat hook-and-loop fastener patch, which is provided on at least one side with a hook-and-loop fastener portion of hooks or loops.

3. The wraparound carrier device according to claim 2, wherein the waist belt is provided with a flap, which is foldable towards the inner side of the waist belt, on an edge directed away from the lower edge of the wraparound carrier part, wherein the flap is equipped with a hook-and-loop fastener portion of hooks or loops on a side which can be brought into contact with the inner side of the waist belt, and/or the waist belt is provided with a hook-and-loop fastener portion of hooks or loops in a region that can be covered by the folded flap.

4. The wraparound carrier device according to claim 3, wherein a plurality of flaps extending over the entire length of the waist belt are provided.

5. The wraparound carrier device according to claim 2, wherein a side edge flap, which can be folded towards the inner side of the wraparound carrier part, is provided on each side edge of the wraparound carrier part, wherein the side edge flap is equipped with a hook-and-loop fastener portion of hooks or loops on a side which can be brought into contact with the inner side of the wraparound carrier part, and/or the wraparound carrier part is equipped with a hook-and-loop fastener portion of hooks or loops along the side edge in a region that can be covered by the folded side edge flap.

6. The wraparound carrier device according to claim 3, wherein on the lower edge of the wraparound carrier part, side regions are provided which can be folded independently of the waist belt in the direction of the center of the wraparound carrier part, on which a tail extending the side edge is provided, which is equipped on at least one side with a hook-and-loop fastener portion of hooks or loops in a region overlapping the waist belt.

7. The wraparound carrier device according to claim 2, wherein the shoulder straps are designed to be connected to the hook-and-loop fastener patch at their second ends via click fasteners.

8. The wraparound carrier device according to claim 1, wherein markings are provided on the waist belt and/or the side edges.

9. The wraparound carrier device according to claim 8, wherein each of the markings is equipped with a hook-and-loop fastener portion of hooks or loops and is attachable to the hook-and-loop fastener portion of the waist belt or the hook-and-loop fastener portion of the wraparound carrier part at any position.

10. The wraparound carrier device according to claim 8, wherein the markings are provided in pairs, and a color is assigned to each pair of the markings, in which at least one region pointing away from the wraparound carrier part is colored.

* * * * *